US010569327B2

(12) United States Patent
Bullied et al.

(10) Patent No.: US 10,569,327 B2
(45) Date of Patent: Feb. 25, 2020

(54) METHOD AND SYSTEM FOR DIE CASTING A HYBRID COMPONENT

(71) Applicant: United Technologies Corporation, Farmington, CT (US)

(72) Inventors: Steven J. Bullied, Pomfret Center, CT (US); John Joseph Marcin, Marlborough, CT (US); Carl R. Verner, Windsor, CT (US)

(73) Assignee: United Technologies Corporation, Farmington, CT (US)

( * ) Notice: Subject to any disclaimer, the term of this patent is extended or adjusted under 35 U.S.C. 154(b) by 3 days.

(21) Appl. No.: 15/892,457

(22) Filed: Feb. 9, 2018

(65) Prior Publication Data

US 2018/0161862 A1 Jun. 14, 2018

Related U.S. Application Data

(62) Division of application No. 13/248,338, filed on Sep. 29, 2011, now Pat. No. 9,925,584.

(51) Int. Cl.

| | |
|---|---|
| ***B22D 17/24*** | (2006.01) |
| ***B22D 17/10*** | (2006.01) |
| ***B22D 17/14*** | (2006.01) |
| ***B22D 21/00*** | (2006.01) |
| ***B22D 21/02*** | (2006.01) |

(Continued)

(52) U.S. Cl.

CPC ..... *B22D 17/24* (2013.01); *B22D 17/10* (2013.01); *B22D 17/14* (2013.01); *B22D 19/00* (2013.01); *B22D 21/002* (2013.01); *B22D 21/025* (2013.01); *B22D 27/045* (2013.01)

(58) Field of Classification Search

CPC ..... B22D 17/24; B22D 17/10; B22D 17/14; B22D 19/00; B22D 21/002; B22D 21/025; B22D 27/045; B22C 9/101; B22C 9/22

See application file for complete search history.

(56) References Cited

U.S. PATENT DOCUMENTS

| | | | |
|---|---|---|---|
| 1,686,069 | A | 10/1928 | Bucklen |
| 3,514,216 | A | 5/1970 | McAninch |
| 3,810,711 | A | 5/1974 | Emmerson et al. |

(Continued)

FOREIGN PATENT DOCUMENTS

| | | |
|---|---|---|
| EP | 0089155 A2 | 9/1983 |

OTHER PUBLICATIONS

Search and Examination Report for Singapore Patent Application No. 201205539-8 dated Jan. 16, 2014.

(Continued)

*Primary Examiner* — Kevin P Kerns
*Assistant Examiner* — Steven S Ha
(74) *Attorney, Agent, or Firm* — Carlson, Gaskey & Olds, P.C.

(57) ABSTRACT

A die casting system includes a die including at least one die component that defines a die cavity, a spar received within a portion of said die cavity, a shot tube in fluid communication with the die cavity, and a shot tube plunger moveable within the shot tube to communicate a molten metal into the die cavity to cast a hybrid component. The spar establishes an internal structure of the hybrid component, and one of the internal structures and an outer structure of said hybrid component is an equiaxed structure.

16 Claims, 3 Drawing Sheets

(51) Int. Cl.
*B22D 27/04* (2006.01)
*B22D 19/00* (2006.01)

(56) References Cited

U.S. PATENT DOCUMENTS

| | | | | |
|---|---|---|---|---|
| 3,965,963 | A | 6/1976 | Phipps et al. | |
| 4,118,927 | A | 10/1978 | Kronogard | |
| 5,024,813 | A | 6/1991 | Nishiyama | |
| 5,609,922 | A | 3/1997 | McDonald | |
| 5,832,981 | A | 11/1998 | McDonald et al. | |
| 6,070,643 | A | 6/2000 | Colvin | |
| 6,190,133 | B1 | 2/2001 | Ress, Jr. et al. | |
| 6,453,979 | B1 | 9/2002 | Soderstrom et al. | |
| 6,607,358 | B2 | 8/2003 | Finn et al. | |
| 6,648,055 | B1 * | 11/2003 | Haug | B22D 19/14 164/113 |
| 6,696,144 | B2 | 2/2004 | Holowczak et al. | |
| 6,709,771 | B2 | 3/2004 | Allister | |
| 6,913,064 | B2 | 7/2005 | Beals et al. | |
| 7,094,035 | B2 | 8/2006 | Kramer et al. | |
| 7,153,096 | B2 | 12/2006 | Thompson et al. | |
| 7,278,826 | B2 | 10/2007 | Blaskovich | |
| 7,322,396 | B2 | 1/2008 | Govern et al. | |
| 7,347,664 | B2 | 3/2008 | Kayser et al. | |
| 8,142,163 | B1 * | 3/2012 | Davies | F01D 5/147 416/225 |
| 2001/0002617 | A1 * | 6/2001 | Schofield | B22D 17/14 164/61 |
| 2003/0175122 | A1 * | 9/2003 | Zhao | F01D 5/14 416/241 B |
| 2005/0205232 | A1 | 9/2005 | Wang et al. | |
| 2007/0131382 | A1 | 7/2007 | Otero et al. | |
| 2009/0029076 | A1 | 1/2009 | Manda | |
| 2009/0077802 | A1 | 3/2009 | Moroso et al. | |
| 2009/0081032 | A1 | 3/2009 | Moroso et al. | |
| 2009/0229780 | A1 | 9/2009 | Phipps et al. | |
| 2010/0300394 | A1 | 12/2010 | Song et al. | |
| 2011/0000634 | A1 | 1/2011 | Erhard et al. | |
| 2011/0203764 | A1 | 8/2011 | Goettsch | |

OTHER PUBLICATIONS

Extended European Search Report for European Application No. 12186143.9 dated Jan. 20, 2017.

* cited by examiner

METHOD AND SYSTEM FOR DIE CASTING A HYBRID COMPONENT

CROSS-REFERENCE TO RELATED APPLICATIONS

This is a divisional application of U.S. patent application Ser. No. 13/248,338 which was filed on Sep. 29, 2011.

BACKGROUND

This disclosure generally relates to casting, and more particularly to a method and system for die casting a hybrid component.

Casting is a known technique used to yield substantially net shaped components. For example, investment casting is often used in the gas turbine engine industry to manufacture near net-shaped components, such as blades and vanes having relatively complex shapes. Investment casting involves pouring molten metal into a ceramic shell having a cavity in the shape of a component to be cast. Investment casting can be relatively labor intensive, time consuming and expensive.

Another known casting technique is die casting. Die casting involves injecting molten metal directly into a reusable die to yield near net-shaped components. Die casting has typically been used to product components that do not require high thermal mechanical performance. For example, die casting is commonly used to produce components used from relatively low melting temperature materials that are not exposed to extreme temperatures.

SUMMARY

A method for die casting a hybrid component includes defining a cavity within a die element of a die and inserting a spar into the cavity. Molten metal is injected into the die element. The molten metal is solidified within the cavity to cast the hybrid component. The spar establishes an internal structure of the hybrid component. The spar includes a high melting temperature material that defines a first melting temperature greater than a second melting temperature of the molten metal.

In another exemplary embodiment, a die casting system includes a die comprised of at least one die element that defines a die cavity. A spar is received within the die cavity. A shot tube is in fluid communication with the die cavity. A shot tube plunger is moveable within the shot tube to communicate a molten metal into the die cavity to cast a hybrid component. The spar establishes an internal structure of the hybrid component. At least one of the internal structure and an outer structure of the hybrid component is an equiaxed structure.

The various features and advantages of this disclosure will become apparent to those skilled in the art from the following detailed description. The drawings that accompany the detailed description can be briefly described as follows.

DETAILED DESCRIPTION

Figure 1:
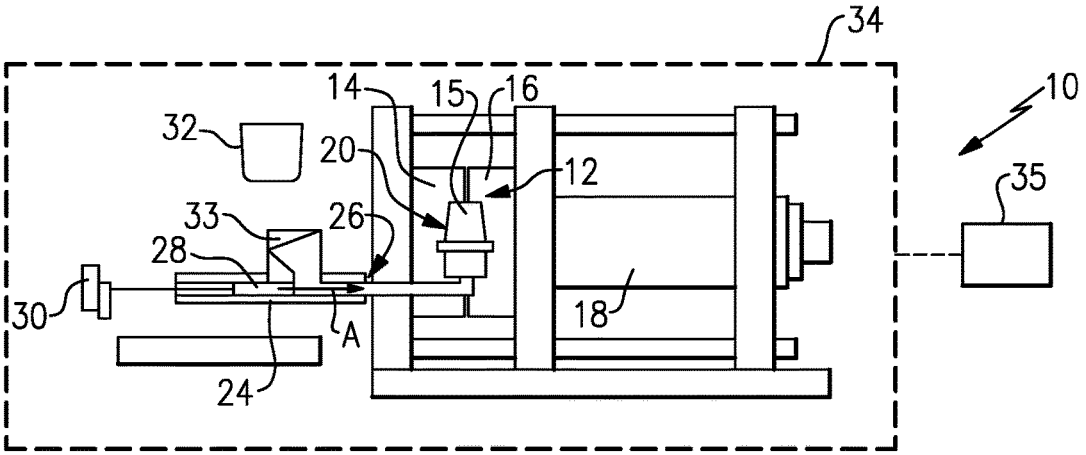
FIG. 1 illustrates an example die casting system.
Figure 4:
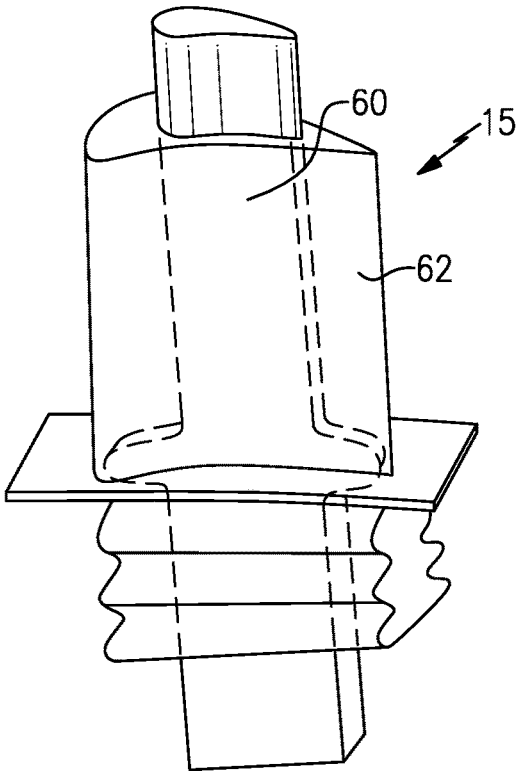
FIG. 4 illustrates an example component cast with a die casting system.

FIG. 1 illustrates a die casting system 10 including a reusable die 12 having a plurality of die elements 14, 16 that function to cast a component 15 (such as the hybrid component 15 depicted in FIG. 4, for example). Although two die elements 14, 16 are depicted by FIG. 1, it should be understood that the die 12 could include more or fewer die elements, as well as other parts and configurations.

The die 12 is assembled by positioning the die elements 14, 16 together and holding the die elements 14, 16 at a desired positioning via a mechanism 18. The mechanism 18 could include a clamping mechanism powered by a hydraulic system, a pneumatic system, an electromechanical system and/or other systems. The mechanism 18 also separates the die elements 14, 16 subsequent to casting.

The die elements 14, 16 define internal surfaces that cooperate to define a die cavity 20. A shot tube 24 is in fluid communication with the die cavity 20 via one or more ports 26 that extend into communication with the die element 14, the die element 16 or both. A shot tube plunger 28 is receded within the shot tube 24 and is moveable between a retracted and injection position (in the direction of arrow A) within the shot tube 24 by a mechanism 30. The mechanism 30 could include a hydraulic assembly or other suitable mechanism including, but not limited to, hydraulic, pneumatic, electromechanical or any combination of systems.

The shot tube 24 is positioned to receive a molten metal from a melting unit 32, such as a crucible, for example. The melting unit 32 may utilize any known technique for melting an ingot of metallic material to prepare a molten metal for delivery to the shot tube 24, including but not limited to, vacuum induction melting, electron beam melting and induction skull melting. Other melting techniques are contemplated as within the scope of this disclosure. The molten metal is melted by the melting unit 32 at a location that is separate from a shot tube 24 and the die 12. In this example, the melting unit 32 is positioned in close proximity to the shot tube 24 to reduce the required transfer distance between the molten metal and the shot tube 24.

The molten metal is transferred from the melting unit 32 to the shot tube 24 in a known manner, such as pouring the molten metal into a pour hole 33 in the shot tube 24. A sufficient amount of molten metal is communicated into the shot tube 24 to fill the die cavity 20. The shot tube plunger 28 is actuated to inject the molten metal under pressure from the shot tube 24 into the die cavity 20 to cast the hybrid component 15. Although the casting of a single component is depicted, the die casting system could be configured to cast multiple components in a single shot.

Although not necessary, at least a portion of the die casting system 10 may be positioned within a vacuum chamber 34 that includes a vacuum source 35. A vacuum is applied in the vacuum chamber 34 via the vacuum source 35 to render a vacuum die casting process. The vacuum chamber 34 provides a non-reactive environment for the die casting system 10 that reduces reaction, contamination or other conditions that could detrimentally affect the quality of the cast component, such as excess porosity of the die casting component that can occur as a result of exposure to air. In one example, the vacuum chamber 34 is maintained at a pressure between $5\times10^{-3}$ Torr (0.666 Pascal) and $1\times10^{-4}$ Torr (0.000133 Pascal), although other pressures are contemplated. The actual pressure of the vacuum chamber 34 will vary based upon the type of component being cast, among other conditions and factors. In the illustrated example, each of the melting unit 32, the shot tube 24 and the die 12 are positioned within the vacuum chamber 34 during the die casting process such that the melting, injecting and solidifying of the metal are all performed under vacuum. In another example, the vacuum chamber 34 is backfilled with an inert gas, such as argon, for example, to provide partial or positive pressure.

The example die casting system 10 depicted by FIG. 1 is illustrative only and could include more or fewer sections, parts and/or components. This disclosure extends to all forms of die casting, including but not limited to, horizontal, inclined, vertical or other die casting systems.

The die elements 14, 16 of the die 12 can be preheated before injection of the molten metal. For example, the die 12 may be preheated between approximately 200° F./93° C. and approximately 1600° F./871° C. Among other benefits, preheating the die elements 14, 16 reduces thermal mechanical fatigue experienced by these components during the injection of the molten metal.

Figure 2A:
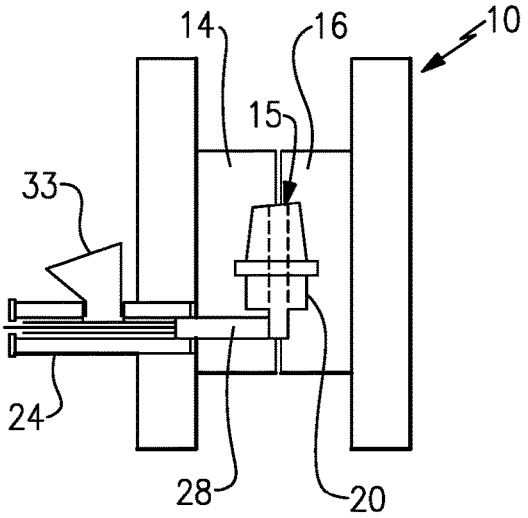
FIG. 2A illustrates a die casting system during casting of a component.
Figure 2B:
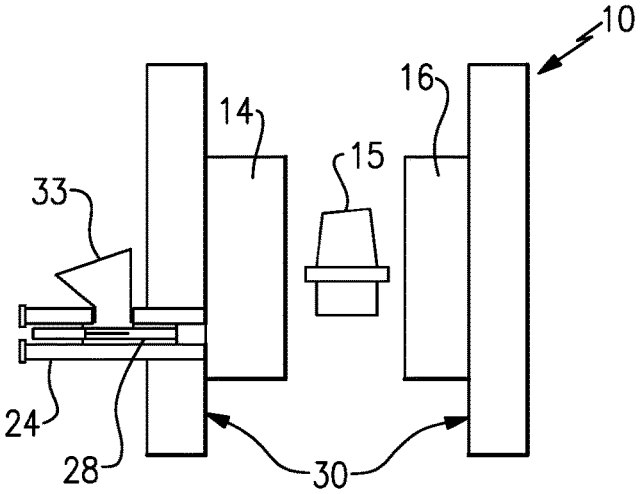
FIG. 2B illustrates a die casting system upon separation from a cast component.

FIGS. 2A and 2B illustrate portions of a die casting system 10 during casting (FIG. 2A) and after die element 14, 16 separation (FIG. 2B). After the molten metal solidifies within a die cavity 20, the die elements 14, 16 are disassembled relative to the hybrid component 15 by opening the die via the mechanism 18. A die release agent may be applied to the die elements 14, 16 of the die 12 prior to injection to achieve a simpler release of the hybrid component 15 relative to the die 12 post solidification.

Figure 3:
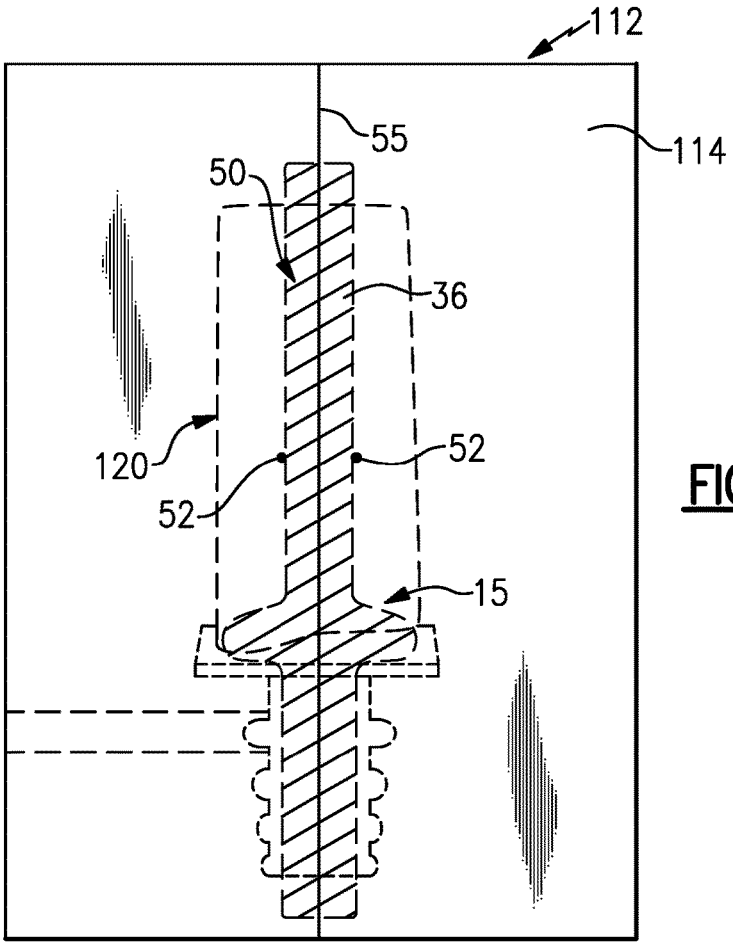
FIG. 3 illustrates a die element of a die of a die casting system.
Figure 6A:
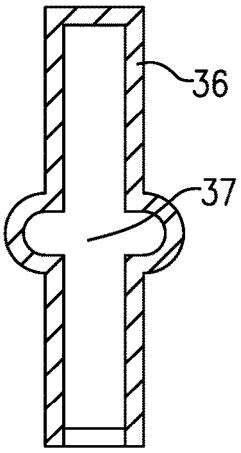
FIGS. 6A and 6B illustrate example spars for use with a die casting system.
Figure 6B:
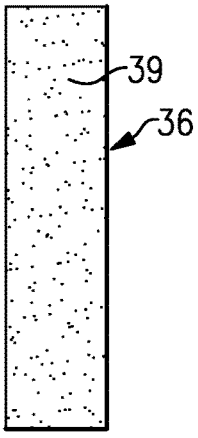

FIG. 3 illustrates an example die element 114 of a die 112 that can be incorporated into a die casting system. The die element 114 receives a spar 36 in order to cast a hybrid component. A cavity 50 is formed in the die element 114 to receive the spar 36. The spar 36 can extend across a split line 55 of the die 112. The spar 36 can also define a hollow portion 37 (See FIG. 6A). The spar can be generally T-shaped (FIG. 3), or can include other shapes, including a generally straight body (See FIG. 6B).

The spar 36 may also include a coating 39 (See FIG. 6B) that protects the spar 36 from extreme temperatures. In addition, a coating can be used to enable an adequate bond between the spar 36 and the molten metal introduced into the die casting system. These coatings may be metallic, ceramic, organic or a combination of these and other suitable materials.

The cavity 50 can be separate from or combined with a die cavity 120 of the die 112. For example, the cavity 50 can be machined into the die cavity 120. The spar 36 can be inserted into the die element 114 before the die 112 is assembled. Alternatively, the die 112 and the spar 36 are assembled simultaneously.

The spar 36 is captured and retained in position by associated surfaces of the die element 114. For example, the die element 114 can include one or more locking features 52 that capture the spar 36 and maintain a positioning of the spar 36 within the die element 114. Additionally, a portion of the spar 36 may be captured by associated compartments of the die element 114 that fall outside of the ultimately cast component. A person of ordinary skill in the art having the benefit of this disclosure will be able to insert the spar 36 within the die element 114 in a fixed manner. The actual configuration of the spar 36 within the die element 114 is design dependent on multiple factors including but not limited to the type of hybrid component 15 that is cast.

The spar 36 can be composed of a high melting temperature material. For example, the spar 36 could include a material such as a refractory metal, a ceramic material, a ceramic matrix composite material or a metal matrix composite material. As used herein, the term "high melting temperature material" is intended to include materials having a melting temperature of approximately 1,000° F./538° C. and higher. In one example, the spar 36 and the die element 114 are made from the same materials.

The spar 36 is shaped and positioned within the die element 114 to establish an internal structure of a hybrid component 15. For example, where the hybrid component 15 is to be implemented within a gas turbine engine, the spar 36 can be shaped and positioned within the die element 114 to form an internal cooling scheme of a gas turbine engine turbine blade.

An outer structure of the hybrid component 15 (i.e., the portion of the cast component that surrounds the spar 36) may include an equiaxed structure upon solidification, or could include other structures. An equiaxed structure is one that includes a randomly oriented grain structure having multiple grains. The spar 36 can include a non-equiaxed structure, an equiaxed structure, a non-metallic structure or could include other structures.

FIG. 4 illustrates an example hybrid component 15 that may be cast using a die casting system. In this example, the hybrid component 15 is a blade for a gas turbine engine, such as a turbine blade for a turbine section of a gas turbine engine. However, this disclosure is not limited to the casting of blades. For example, the example die casting system 10 of this disclosure could be utilized to cast aeronautical components including blades, vanes, panels, boas and any other structural part of the gas turbine engine. In addition, non-aeronautical components can be cast. In this disclosure, the term "hybrid component" includes components that are made from more than one type of material.

For example, the hybrid component 15 includes an internal structure 60 (defined by the spar 36) and an outer structure 62 (defined by solidification of molten metal within a die, such as the die 112 described above) that surrounds the internal structure 60. The outer structure 62 can include an equiaxed structure or other structures, while the internal structure 60 can include a non-equiaxed structure. The internal structure could also include an equiaxed or a non-metallic structure, such as a ceramic, for example. In one example, the internal structure 60 is a hollow structure to reduce weight of the hybrid component 15. A portion of the internal structure 60 may extend beyond the outer structure 62 post-cast. This portion can be removed using known techniques.

Figure 5:
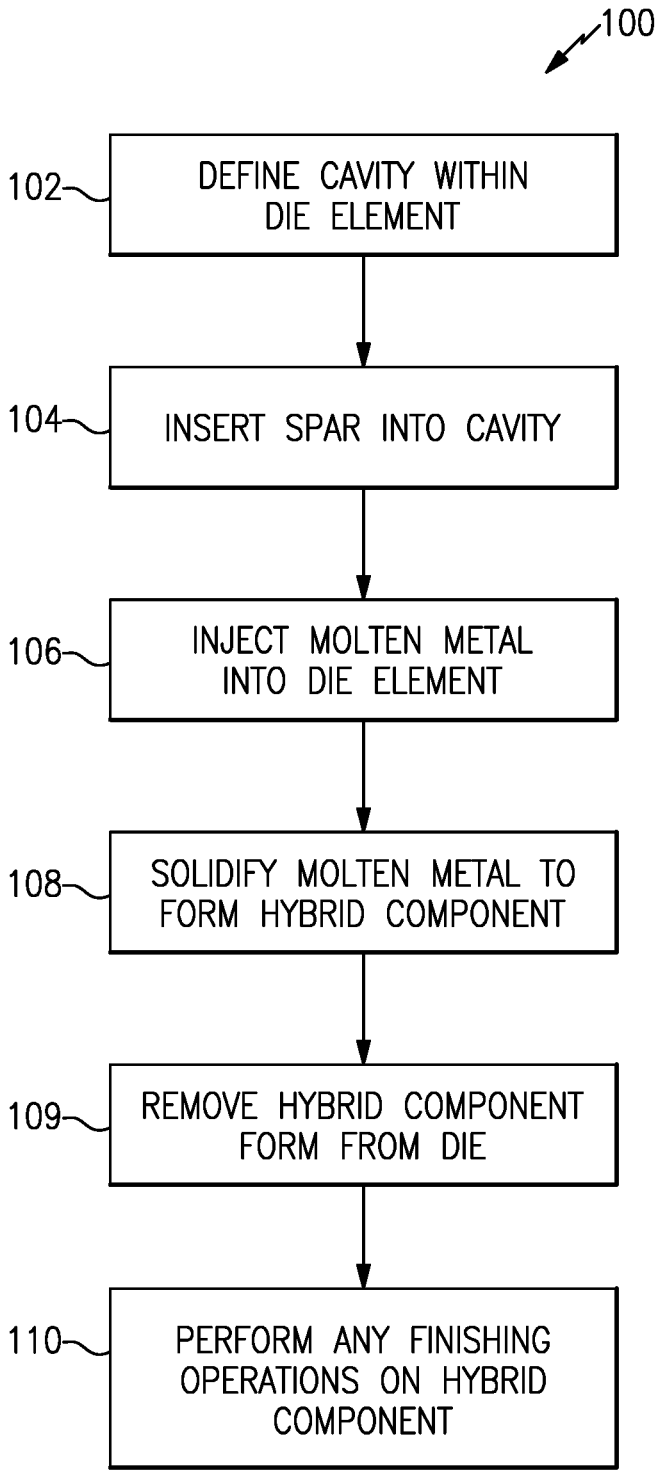
FIG. 5 schematically illustrates an example implementation of a die casting system.

FIG. 5, with continued reference to FIGS. 1-4, schematically illustrates an example implementation 100 of the die casting systems described above. The exemplary implementation 100 can be utilized to die cast a hybrid component, such as the hybrid component 15 described above, or any other hybrid component.

The implementation 100 begins at step block 102 by defining a cavity within a die element of a die. At step block 104, a spar is inserted into the cavity defined at step block 102. Next, at step block 106, molten metal is injected into the die element. At step block 108, the molten metal is solidified within the cavity to form a hybrid component. The hybrid component is then removed from the die at step block 109.

The spar establishes an internal structure within the hybrid component after solidification. The spar includes a high melting temperature material that defines a first melting temperature. The molten metal includes a material having a second melting temperature that is less than the first melting temperature of the high melting temperature material of the spar. For example, the molten metal could include an oxidation and damage resistant alloy such as titanium, cobalt, a nickel based alloy, brass, bronze, steel, cast iron or other material. The cast hybrid component may then be subjected to finishing operations at step block 110, including but not limited to, machining, surface treating, coating or any other desirable finishing operation.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A die casting system, comprising:

a die that includes at least one die component that defines a die cavity;

a spar received within a portion of said die cavity, wherein said spar includes a ceramic material, and wherein said spar is generally T-shaped;

a shot tube in fluid communication with said die cavity;

a shot tube plunger moveable within said shot tube to communicate a molten metal into said die cavity to cast a hybrid component, wherein said spar establishes an internal structure of said hybrid component, and wherein one of said internal structure and an outer structure of said hybrid component is an equiaxed structure.

2. The die casting system as recited in claim 1, wherein said spar includes a high melting temperature material that defines a first melting temperature greater than a second melting temperature of said molten metal.

3. The die casting system as recited in claim 1, wherein said spar includes a hollow portion.

4. The die casting system as recited in claim 1, wherein said die casting system is a vacuum die casting system.

5. The die casting system as recited in claim 1, wherein said spar extends along a split line of said die.

6. The die casting system as recited in claim 1, wherein said spar includes a coating.

7. The die casting system as recited in claim 1, wherein said spar is completely hollow between its outer walls.

8. The die casting system as recited in claim 1, comprising at least one locking feature that captures said spar within said die.

9. The die casting system as recited in claim 1, wherein said spar and said die are made from the same material.

10. A die casting system, comprising:

a die that includes at least one die component that defines a die cavity;

a generally T-shaped spar received within a portion of said die cavity and extending along a split line of said die, the spar including outer walls providing said general T-shape and being completely hollow between said outer walls;

a shot tube in fluid communication with said die cavity; and a shot tube plunger moveable within said shot tube.

11. The die casting system as recited in claim 10, wherein said spar includes a refractory metal.

12. The die casting system as recited in claim 10, wherein said spar includes a ceramic material.

13. The die casting system as recited in claim 10, wherein said spar includes a ceramic matrix composite.

14. The die casting system as recited in claim 10, wherein said spar includes a metal matrix composite.

15. The dies casting system as recited in claim 10, wherein the spar has a melting temperature of approximately 1,000° F./538° C. and higher.

16. A die casting system, comprising:

a die that includes at least one die component that defines a die cavity for casting a blade for a gas turbine engine;

a generally T-shaped ceramic spar received within a portion of said die cavity and extending along a split line of said die, the spar including outer walls providing said general T-shape and being completely hollow between said outer walls, wherein the spar includes a coating, and the spar establishes an internal structure of said blade, such that the spar is received within an airfoil portion, a platform portion, and a root portion of said blade;

a shot tube in fluid communication with said die cavity; and a shot tube plunger moveable within said shot tube to communicate a molten metal into said die cavity to cast said blade.

* * * * *